US006091034A

United States Patent [19]

Glassburn et al.

[11] Patent Number: 6,091,034

[45] Date of Patent: Jul. 18, 2000

[54] LOW COST FLUID PRESSURE RESPONSIVE ELECTRIC SWITCH HAVING INCREASED LONGEVITY

[75] Inventors: Robin S. Glassburn, Lexington; Russell D. Foley, Versailles, both of Ky.

[73] Assignee: Texas Instruments Incorporated, Dallas, Tex.

[21] Appl. No.: 09/398,128

[22] Filed: Sep. 17, 1999

[51] Int. Cl.[7] ..... H01H 35/34

[52] U.S. Cl. ..... 200/83 P

[58] Field of Search ..... 200/83 R, 83 B, 200/83 D, 83 J, 83 P, 835, 835 A, 83 T, 83 V, 83 Y, 83 W

[56] References Cited

U.S. PATENT DOCUMENTS

| | | | |
|---|---|---|---|
| 2,906,132 | 9/1959 | Moody et al. | 74/100 |
| 3,535,480 | 10/1970 | Bahniuk | 200/83 |
| 3,688,064 | 8/1972 | Myers | 200/83 N |
| 4,514,717 | 4/1985 | Doherty, Jr. | 337/365 |
| 4,782,318 | 11/1988 | Boulanger | 337/380 |
| 5,015,808 | 5/1991 | Czarn et al. | 200/83 P |
| 5,461,208 | 10/1995 | McKenna | 200/83 J |
| 5,471,022 | 11/1995 | Kiss et al. | 200/83 B |
| 5,661,278 | 8/1997 | Atkinson et al. | 200/83 J |
| 5,814,779 | 9/1998 | Verras et al. | 200/83 P |

*Primary Examiner*—Michael Friedhofer
*Attorney, Agent, or Firm*—Russell E. Baumann; Frederick J. Telecky, Jr.

[57] ABSTRACT

A fluid pressure responsive electrical switch (10) is shown having a generally flat base (12) formed with an annular recess (12*e*) which receives therein the distal free end of a cup-shaped resilient membrane (16) captured by the distal free end of a tubular sidewall (14*a*) of housing (14). Membrane (16) defines a dampener chamber (16*d*) having a constricting orifice (12*f*) to a fluid pressure receiving portion (12*d*) of the switch. The top wall (16*a*) of the membrane is adapted to transfer fluid pressure to a snap-acting disc (18) which, when actuated by a selected high pressure build-up within the dampener chamber, will in turn engage the bight (22*f*) of movable contact arm (22*c*) and move the movable contact arm to separate movable contact (26) from stationary contact (24) mounted within a switch chamber (14*d*) of housing (14).

9 Claims, 2 Drawing Sheets

LOW COST FLUID PRESSURE RESPONSIVE ELECTRIC SWITCH HAVING INCREASED LONGEVITY

FIELD OF THE INVENTION

This invention relates generally to fluid pressure responsive electric switches and more particularly to such switches used for small water pumps in boats and recreational vehicles as well as various other commercial applications in which low cost as well as optimized longevity are desired.

BACKGROUND OF THE INVENTION

It is known to use snap-acting discs having a dished-shape configuration as fluid pressure sensors to control the energization of an electric circuit in response to selected fluid pressure conditions. Such discs are typically mounted in a recess formed in a housing in pressure receiving relation with a fluid pressure source sealed from the fluid as by a flexible flat membrane disposed over the recess and attached to the housing. An electric switch is mounted in the housing having a movable contact mounted on a movable contact arm and adapted to move into and out of engagement with a stationary contact and with an elongated motion transfer pin either directly attached to the movable arm or mounted in a guide hole placed between the movable arm and the disc so that when the disc snaps from one configuration to an oppositely dished configuration upon the occurrence of a selected pressure condition of the fluid pressure source being monitored, motion is transferred from the disc to the movable arm to move the movable contact either into or out of engagement with the stationary contact.

In certain markets, due to competitive reasons, there is a continuing need to minimize the cost of the pressure switch and at the same time to maximize the expected useful life of the switch. Failure modes of switches of the type described include fatigue of the sealing membrane used to transfer pressure from the fluid to the disc exacerbated by the repetitious stretching of the membrane in a direction perpendicular to the surface of the membrane in its weakest direction. Another failure mode occurs in switches having free motion transfer pins which often develop contamination in the switch cavity from the wearing of parts. Another cause of failure of switches having normally free discs occurs when such a disc becomes trapped in a skewed orientation in a disc receiving recess of the housing.

SUMMARY OF THE INVENTION

It is an object of the present invention to provide a pressure responsive electric switch free of the above noted prior art limitations. Another object is the provision of such a switch which has fewer component parts than conventional switches and which is easily assembled. Yet another object is the provision of a pressure switch which has enhanced longevity and one which is less sensitive to momentary high pressure spikes.

Briefly, in accordance with the invention, a recess is formed in a generally flat base with a small orifice formed through the bottom wall of the recess. A generally cup-shaped membrane formed of flexible material has a sidewall depending from a top wall with the distal free end of the sidewall received in the recess around the orifice with the membrane forming a dampening chamber. The distal free end of the sidewall of the membrane is captured in the recess by the distal free end of a tubular sidewall of a housing member attached to the base. A radially, inwardly extending flange is formed in the sidewall of the housing member forming a circular opening to a switch chamber at a location spaced along a longitudinal axis a selected distance from the distal free end of the tubular sidewall forming a disc seating ledge at a location closely adjacent the top wall of the membrane. A snap-acting disc having a normally upwardly facing concave configuration is disposed on the disc seat and held there by the top wall of the flexible membrane. A pair of spaced apart, upwardly opening slots are formed in the switch chamber with a leg of first and second terminal members received in respective slots. A stationary contact is fixed to the first terminal member while a flexible, generally U-shaped movable contact arm having first and second legs extending from a bight has one leg fixedly attached to the second terminal member and a movable contact fixedly attached to the distal free end of the other leg of the movable contact arm and adapted to move into and out of engagement with the stationary contact and with the bight disposed closely adjacent to the snap-acting disc. The switch is placed so that the orifice is in fluid receiving relationship with a fluid source whose pressure is to be monitored. Upon a selected increase in fluid pressure within the dampening chamber sufficient pressure will be transferred though the membrane to cause the snap-acting disc to snap to its opposite, upwardly facing convex configuration engaging the bight of the movable contact arm and moving it, along with the movable contact, into a contacts disengaged position.

BRIEF DESCRIPTION OF THE DRAWINGS

Other objects, advantages and details of the pressure responsive switch made in accordance with the invention appear in the following detailed description of the preferred embodiment of the invention, the detailed description referring to the drawings in which.

DETAILED DESCRIPTION OF THE PREFERRED EMBODIMENT

Figure 1:
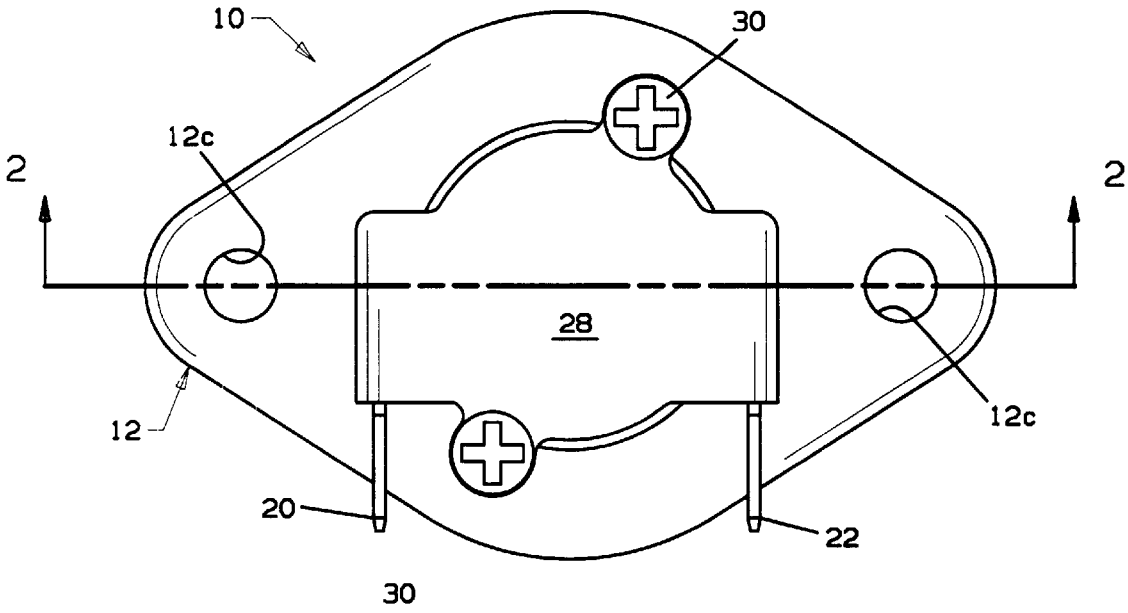
FIG. 1 is a top plan view of a fluid pressure responsive electric switch made in accordance with the preferred embodiment of the invention.

Referring to the drawings, numeral 10 indicates a fluid pressure responsive electrical switch made in accordance with the invention comprising a generally flat base 12 formed of suitable material such as a moldable synthetic resin having a top surface 12*a* and a bottom surface 12*b*. Mounting holes 12*c* are formed through the base for mounting the switch so that a fluid receiving portion 12*d* on bottom surface 12*b* is disposed in communication with a fluid pressure source (not shown). A generally circular recess 12*e* is formed on top surface 12*a* of the base to serve as seat for a membrane, to be discussed, and a small orifice 12*f*, e.g., on the order of 0.020 inch diameter, is provided through the base within the central area defined by the annular seat. It will be noted that orifice 12*f* has an increasing larger diameter as one goes in a direction away from the surface of the fluid receiving portion 12*d* to allow fluid to move more easily through the orifice from the radiused side than vice versa.

A housing 14 formed of electrically insulative, preferably moldable synthetic material has a depending cylindrical, tubular lower side wall 14*a* having an outer diameter selected to fit within recess 12*e* of base 12. The distal free end of wall 14*a* has an inwardly facing cut-out portion defining a ledge 14*b* lying in a plane generally parallel to the plane in which the bottom surface of recess 12*e* lies.

A flange 14*c*, forming a circular hole, extends radially inwardly from sidewall 14*a* forming a seat for disc 18, to be discussed, the circular hole opening into a switch chamber 14*d*. Flange 14*c* is spaced along the longitudinal axis of cylindrical, tubular wall 14*a* a distance selected to form a dampener chamber, as will be discussed.

A cup-shaped membrane 16 is formed of flexible, resilient material and has a generally circular top wall 16*a* with a depending sidewall 16*b*. A flange 16*c* is formed at the distal free end of sidewall 16*b* and extends radially outwardly. Flange 16*c* has a thickness in the direction of the longitudinal axis of wall 14*a*, preferably slightly greater than the distance of flange 14*b* from the distal end of wall 14*a*. The distal ends of wall 16*a* and tubular sidewall 14*a* are received in recess 12*e* with flange 14*b* of the tubular sidewall compressing flange 16*c* forming a fluid tight seal and with wall 16*a* disposed closely adjacent flange 14*c*.

A pressure responsive, snap-acting disc member 18 having a diameter slightly smaller than the circular opening formed by tubular sidewall 14*a* is disposed between cup-shaped membrane 16 and flange 14*c*. Disc 18 is normally configured with a downwardly facing convex dished shape as shown but upon being exposed to a selected high pressure will snap over to a reverse, downwardly facing concave dished configuration (not shown).

Cup-shaped membrane 16, sealingly mounted in recess 12*e*, along with orifice 12*f* form a dampener chamber 16*d* so that in order to cause disc 18 to actuate, or move to its opposite configuration, an elevated pressure at fluid receiving portion 12*d* must be sustained for an extended period of time in order to have fluid pressure in chamber 16*d* build up to the actuating level of disc 18 thereby making the switch insensitive to momentary spikes of high pressure.

Figure 2:
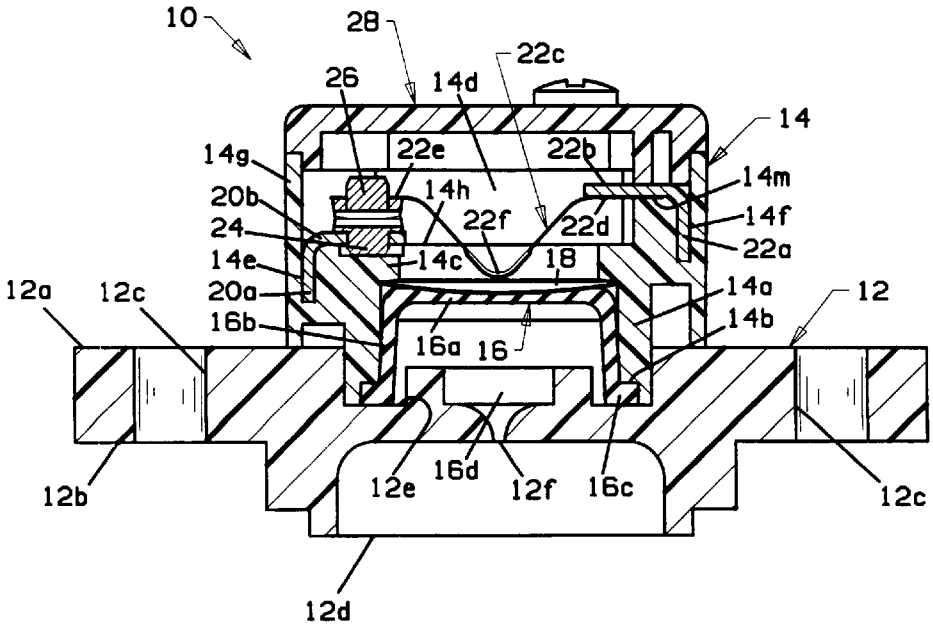
FIG. 2 is a cross-sectional view taken on line 2—2 of FIG. 1.
Figure 3:
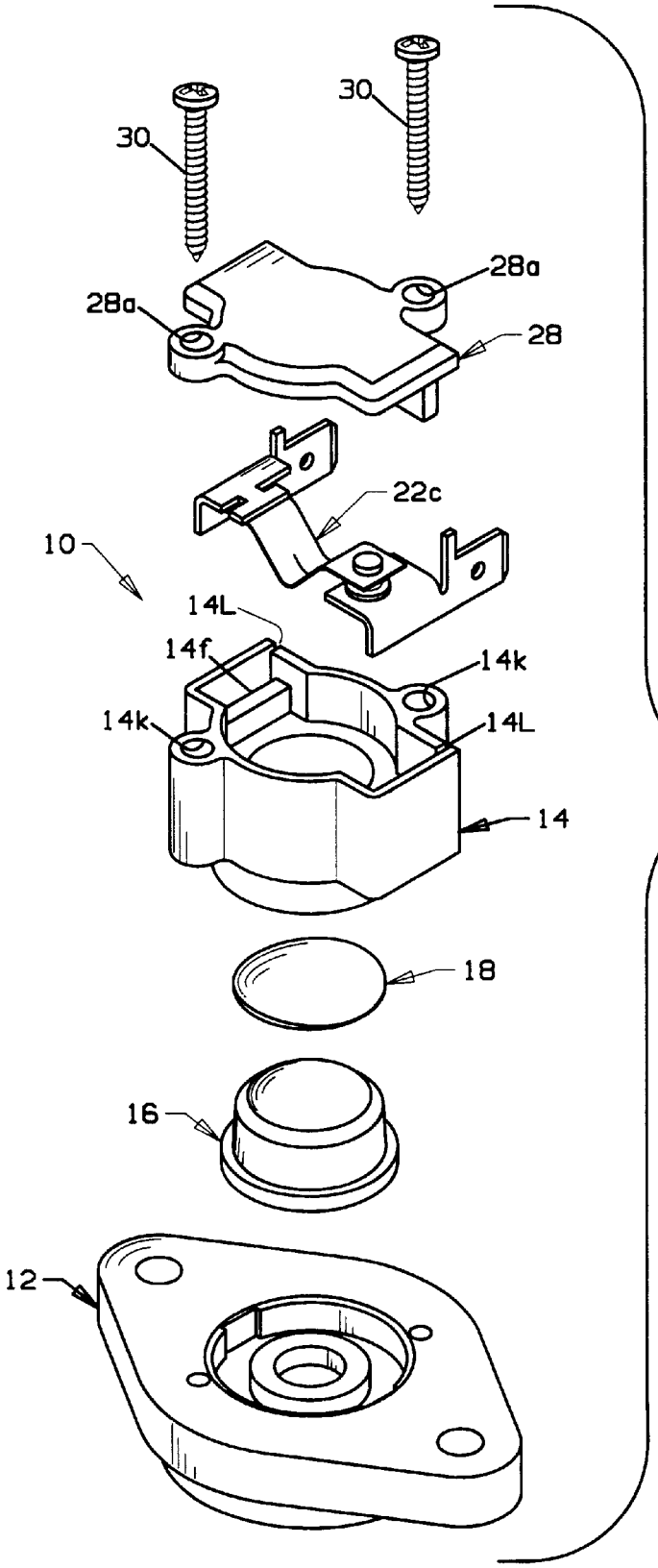
FIG. 3 is an exploded perspective view of the components of the FIGS. 1, 2 switch.

Housing 14 is formed with opposing, spaced apart first and second upwardly opening slots 14*e*, 14*f*. A first terminal member 20 extends through an aperture 14K (FIG. 3) in upper sidewall 14*g* and has a downwardly extending leg 20*a* received in first slot 14*e* and a laterally extending leg 20*b* received on a shelf 14*h*. A stationary electrical contact 24 is mounted on leg 20*b*. Terminal member 22 extends through another aperture 14 (FIG. 3) in upper sidewall 14*g* and has a downwardly extending leg 22*a* received in second slot 14*f* and a laterally extending leg 22*b* received on a shelf 14*m* and into the recess of switch chamber 14*d*. A generally U-shaped, flexible, movable contact arm 22*c* of suitable electrically conductive material having good spring characteristics has the end of one leg 22*d* fixedly attached to leg 22*b* and arranged so that the end of a second leg 22*e* extends over and in alignment with stationary contact 24. A movable electrical contact 26 is mounted on the free distal end of leg 22*e* for movement into and out of engagement with stationary contact 24. Bight portion 22*f* of movable arm 22 is disposed along the longitudinal axis of tubular wall 14*a* closely adjacent to the disc seat formed by flange 14*c*, i.e., the lower surface of flange 14*c* as seen in FIG. 2.

A lid 28 received over switch chamber 14*d* is attached to housing 14 by suitable fasteners such as screws 30 received in holes 28*a* of lid 28 and threaded bores 14*n* of housing 14.

As shown, with the contacts in electrical engagement, an electric circuit extends from terminal 20 through the contacts 24, 26, movable arm 22*c* and terminal 22. When fluid pressure builds up in dampener chamber 16*d* to a selected level based on the pre-calibrated actuation level of disc 18, the disc will snap from the configuration shown to an oppositely dished configuration to move bight 22*f* of movable arm 22*c* upwardly along with movable contact 26 into a contacts disengaged position.

The use of the U-shaped movable arm 22*c* to transfer motion directly from disc 18 eliminates the need for a conventional motion transfer pin thereby reducing parts count of the switch as well as aiding in dampening the impact of the movable contact of the switch to enhance switch life. Elimination of conventional integrated transfer mechanisms allows for elimination of the corresponding integrated joints and concomitant wear thereby eliminating a potential failure mode as well as avoiding contamination in the switch cavity from guiding mechanisms required for conventional transfer mechanisms.

The provision of the relatively large dampener chamber and small orifice provides an effective time constant to reduce rapid cycling and make the switch less sensitive to high pressure spikes.

The disc seat provided by flange 14*c* of housing 14 along with sidewalls 14*a* and membrane 16 engaging the disc results in a mounting for the disc which obviates the possibility of having the disc become trapped in a skewed position which can occur with discs that are allowed to float within a recess when subjected to certain vibrations of the switch.

The cup-shaped configuration of the membrane used as a seal and to transfer fluid pressure to the disc provides the advantage of minimizing distortion of the seal material under use. Conventional flat membranes result in stretching in a direction perpendicular to the membrane in its weakest direction whereas in the cup-shaped membrane 16 of the invention, stretching occurs in a direction more parallel with the membrane material, i.e., parallel with the sidewalls of the cup-shaped configuration. This provides a more robust barrier and enhanced longevity.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed:

1. A fluid pressure responsive electrical switch comprising:

a base member having a top surface, a bottom surface, and a membrane receiving seat, a fluid receiving portion formed on the bottom surface, an orifice formed through the base member within the membrane receiving seat, the orifice opening into the fluid receiving portion, a housing formed of electrically insulating material mounted on the base member having a wall portion with a longitudinal axis and with a free distal end, a generally cup-shaped membrane formed of flexible material having a top wall and a generally cylindrical sidewall with a free end, the free end of the sidewall of the membrane received on the membrane receiving seat forming a dampener chamber within the membrane, the wall portion of the housing having an annular disc seating ledge spaced along the longitudinal axis of the wall portion from the distal free end a distance selected to accommodate the cup-shaped membrane so that the top wall of the membrane is closely adjacent the ledge, the ledge extending radially inwardly and defining a circular opening into a switch chamber, a snap-acting disc received on the annular disc seating ledge, first and second terminal members extending through the housing into the switch chamber at spaced apart locations, a stationary contact mounted on the first terminal member, a flexible, generally U-shaped movable contact arm having a bight portion intermediate two ends, one of the ends of the contact arm fixedly attached to the second terminal member and the other end having a movable contact mounted thereon for movement into and out of engagement with the stationary contact, the bight disposed along the longitudinal axis so that it is closely adjacent to the disc seating ledge when the movable contact is in engagement with the stationary contact whereby sufficient fluid pressure received through the orifice and transferred through the top wall of the membrane to the disc causes the disc to snap from a concave configuration facing the bight to a convex configuration facing the bight transferring motion to the movable contact arm to move the movable contact out of engagement with the stationary contact.

2. A fluid pressure responsive electric switch according to claim 1 in which the orifice has a diameter of approximately 0.020 inch.

3. A fluid pressure responsive electric switch according to claim 2 in which the orifice is formed by a sidewall having a diameter which expands in a direction going from the fluid receiving portion to the interior of the dampener chamber.

4. A fluid pressure responsive electric switch according to claim 1 further comprising a flange extending radially outwardly at the free end of the membrane and the wall portion of the housing has an inwardly facing annular cut-out space defined by a ledge formed in the free distal end thereof, the flange of the membrane being received in the cut-out and captured by the ledge defining the cut-out space in the wall portion.

5. A fluid pressure responsive electrical switch comprising:

a generally flat base member having a top surface and a bottom surface, a generally circular recess formed in the top surface forming a membrane receiving seat, a fluid receiving portion formed on the bottom surface, an orifice formed through the base member within the area defined by the recess, the orifice opening into the fluid receiving portion, a housing formed of electrically insulating material mounted on the base member having a generally cylindrical tubular wall portion with a longitudinal axis and with a free distal end, an inwardly facing annular cut-out defined by a ledge formed in the distal free end of the tubular wall portion, a generally cup-shaped membrane formed of flexible material having a top wall and a generally cylindrical sidewall with a free end having a flange extending radially outwardly at the free end, the free end of the sidewall of the membrane and the distal free end of the tubular wall portion of the housing received in the recess with the flange captured by the ledge of the annular cutout, the membrane and base member forming a dampener chamber, the tubular wall portion of the housing having an annular disc seating ledge spaced along the longitudinal axis of the tubular wall portion from the distal free end a distance selected to accommodate the cup-shaped membrane so that the top wall of the membrane is closely adjacent the ledge, the ledge extending radially inwardly and defining a circular opening into a switch chamber, the tubular wall portion of the housing having an inside diameter and a snap-acting disc having a diameter slightly less than the inside diameter of the housing received on the annular disc seating ledge, first and second terminal members extending through the housing into the switch chamber at spaced apart locations, a stationary contact mounted on the first terminal member and a flexible, generally U-shaped movable contact arm having a bight portion intermediate two ends with one end fixedly attached to the second terminal member and a movable contact mounted on the other end moves into and out of engagement with the stationary contact, the bight disposed along the longitudinal axis so that it is closely adjacent to the disc seating ledge when the movable contact is in engagement with the stationary contact whereby sufficient fluid pressure received through the orifice and transferred through the top wall of the membrane to the disc causes the disc to snap from a concave configuration facing the bight to a convex configuration facing the bight transferring motion to the movable contact arm to move the movable contact out of engagement with the stationary contact.

6. A fluid pressure responsive electric switch according to claim 5 in which the orifice has a diameter of approximately 0.020 inch.

7. A fluid pressure responsive electric switch according to claim 6 in which the orifice is formed by a sidewall having a diameter which expands in a direction going from the fluid receiving portion to the interior of the dampener chamber.

8. A fluid pressure responsive electrical switch comprising:

a housing formed of electrically insulating material having a wall portion with a longitudinal axis and with a distal end, a generally cup-shaped membrane formed of flexible material having a top wall and a generally cylindrical sidewall with a free end, the free end of the sidewall of the membrane received on a membrane receiving seat forming a dampener chamber within the membrane, the wall portion of the housing having an annular disc seating ledge spaced along the longitudinal axis of the wall portion from the distal end of the wall portion a distance selected to accommodate the cup-shaped membrane so that the top wall of the membrane is closely adjacent to the ledge, the ledge extending radially inwardly and defining a circular opening into a switch chamber, a snap-acting disc received on the annular disc seating ledge with the top wall of the membrane placing a bias against the disc seating ledge to prevent dislodgment of the snap-acting disc from the seating ledge, the disc movable between first and second opposite dished configurations, a movable contact arm movable into and out of states of engagement with a stationary contact, the movable contact arm having a portion thereof closely adjacent to the snap-acting disc so that upon movement of the snap-acting disc from one dished configuration to the other dished configuration, the snap-acting disc will move the movable contact arm from one state of engagement to the other state of engagement.

9. A fluid pressure responsive electric switch according to claim 8 in which the movable contact arm is a generally U-shaped integral member formed of electrically conductive material having good spring characteristics having first and second legs with a bight portion therebetween, the bight portion being the portion closely adjacent to the snap-acting disc whereby the bight portion serves as a motion transfer member and with the contact arm also serving as a spring member to provide selected contact force.

* * * * *